US005339806A

United States Patent [19]

Beaussant et al.

[11] Patent Number: 5,339,806

[45] Date of Patent: Aug. 23, 1994

[54] PROTECTIVE EQUIPMENT INCLUDING A CLOSED SUIT

[75] Inventors: Raymond Beaussant, Bretigny; Jacques Frison, Bourgoin Jallieu; Robert Schegerin, Jouy en Josas, all of France

[73] Assignee: Intertechnique, Plaisir, France

[21] Appl. No.: 798,318

[22] Filed: Nov. 26, 1991

[30] Foreign Application Priority Data

Nov. 27, 1990 [FR] France ..... 90 14811

[51] Int. Cl.[5] ..... A62B 7/06

[52] U.S. Cl. ..... 128/201.21; 128/201.22; 128/201.29

[58] Field of Search ..... 128/201.21, 201.29, 128/202.12, 914, 201.22; 2/2.1 A, 2.1 R

[56] References Cited

U.S. PATENT DOCUMENTS

| | | | |
|---|---|---|---|
| 2,423,631 | 7/1947 | Akerman et al. | 128/201.21 |
| 2,990,695 | 7/1961 | Leffingwell, Jr. | 128/201.21 |
| 3,161,192 | 12/1964 | McCormack | 128/201.21 |
| 3,487,765 | 1/1970 | Lang . | |
| 3,528,414 | 9/1970 | Schueller | 2/2.1 A |
| 3,730,178 | 5/1973 | Moreland | 128/201.21 |
| 4,172,454 | 10/1979 | Warncke et al. . | |
| 4,181,126 | 1/1978 | Hendry . | |

FOREIGN PATENT DOCUMENTS

| | | |
|---|---|---|
| 1306894 | 9/1962 | France . |
| 2366028 | 4/1978 | France . |
| 2032255 | 5/1980 | United Kingdom . |

OTHER PUBLICATIONS

Soviet Inventions Illustrated, Section P, C27, Aug. 13, 1980, Derwent Publications Ltd, London, class P35, n° F8905C/27 & SU-A-698625 (ODESSA REFRIG).

*Primary Examiner*—Edgar S. Burr
*Assistant Examiner*—Aaron J. Lewis
*Attorney, Agent, or Firm*—Larson and Taylor

[57] ABSTRACT

An individual protective equipment for use in a hostile environment comprises a closed suit including a flexible gas-tight garment and a helmet having a transparent visor and having a gas-tight connection with the garment. The equipment also includes a portable tank for storage of liquefied breathing gas and a heat exchanger having a primary circuit whose inlet is connected to an outlet of the storage tank and whose outlet feeds a breathing circuit. A gas motor is connected to receive a flow of breathing gas evaporated in the primary circuit and delivers the flow to the breathing circuit. A blower driven by the motor is inserted in a garment ventilation circuit including the secondary circuit of the exchanger.

7 Claims, 2 Drawing Sheets

PROTECTIVE EQUIPMENT INCLUDING A CLOSED SUIT

BACKGROUND OF THE INVENTION

The present invention relates to an individual protective equipment for use in a hostile environment, particularly in an atmosphere which contains harmful or corrosive products, comprising a closed suit provided with a built-in respiratory gas supply and means for ventilating the closed suit.

Equipments of that type are known which include a closed suit comprising a flexible gas-tight garment and a helmet having a transparent visor, which is connectable to a gas supply consisting of a cylinder for delivering pressurized breathing gas.

During work in such an atmosphere, the protective equipment should deliver breathing gas in appropriate quantity and quality and also ventilate the body surface for drawing off heat and avoiding moisture condensation.

Typically gas from the cylinder is fed to an ejector which draws air from the suit and circulates it for ventilation purpose. The atmosphere breathed by the wearer of the protective suit consists of a mixture of delivered breathing gas and of gas from the inside of the suit. Gas delivery from the cylinder is balanced by exit through valves on the suit.

Such known equipments have drawbacks. The ventilation circuit may be considered as open, which results in a waste of breathing gas. There is dilution of the exhalated gas within the whole atmosphere within the suit and the carbon dioxide content rapidly increases and may reach a dangerous value.

As a consequence such equipments are self-sustaining for a short time only, since the volume and weight of the cylinders storing the pressurized gas used for breathing and ventilation should remain within acceptable limits.

The mere substitution of a pressurized breathing gas bottle fails with a liquefied gas supply to cure most of the above-identified drawbacks.

SUMMARY OF THE INVENTION

It is an object of the invention to solve the problem of protection of people who must work on locations of accidents and for that purpose should be provided with an eguipment which authorizes energy expenses consequently a high degree of metabolism, for a long duration without a dangerous increase of the $CO_2$ content in the inhaled gas.

For solving that problem, there is provided an individual protective equipment wherein the breathing gas supply consists of a liquefied gas supply (liquid air, liquid oxygen or even liquid mixture containing helium and/or hydrogen in addition to oxygen and nitrogen) feeding a breathing circuit which opens into the helmet, typically through a regulation valve which may be of conventional construction; in the equipment, the breathing circuit is fed by the supply through the primary circuit of a heat exchanger. A gas motor is located between the heat exchanger and the breathing circuit end drives a blower for circulating ventilation air in the garment within a closed circuit including the exchanger. In the exchanger, the ventilation gas is cooled and dried before it is delivered to the suit.

Return of the ventilation gas to the suit may be through distribution tubes which open at the ends of the limbs, according to an arrangement which is already known, for instance the arrangement described in European Patent publication No. 0,317,415. The ventilation circuit may be entirely closed or possibly partially closed, with a gas outflow, if the equipment is for use in atmosphere.

In a specific embodiment of the invention, the face is separated from the atmosphere which prevails around the body by a joint (face Joint or more frequently neck joint) and the helmet is provided with an exhalation valve. In that way, a separation is readily made between an open breathing circuit which passes through the helmet to atmosphere and the closed ventilation circuit in the garment. Exhalation is directly out of the suit and exhalated moisture and carbon dioxide are not kept within the suit.

In another embodiment of the invention, only part of the breathing gas flow from the primary circuit of the exchanger is delivered to the gas motor while the balance of the gas flow feeds the helmet or a breathing mask through a demand regulator.

In all cases, an economizer bag, which may have a construction and a function similar to those of the bags on the emergency oxygen masks for passengers of commercial planes may be located between the outlet of the gas motor and the inlet into the helmet.

Whatever the embodiment which is selected, the invention makes it possible to use not only the breathable character of the gas stored in the supply, but also its physical condition, since liquefied gas constitutes a source of cold and the pressure of the vaporized gas delivers the amount of energy which is necessary for ventilation.

The invention will be better understood from the following description of particular embodiments of the invention, given as non-limiting examples. The description refers to the accompanying drawings.

DETAILED DESCRIPTION OF PREFERRED EMBODIMENTS

Figure 1:
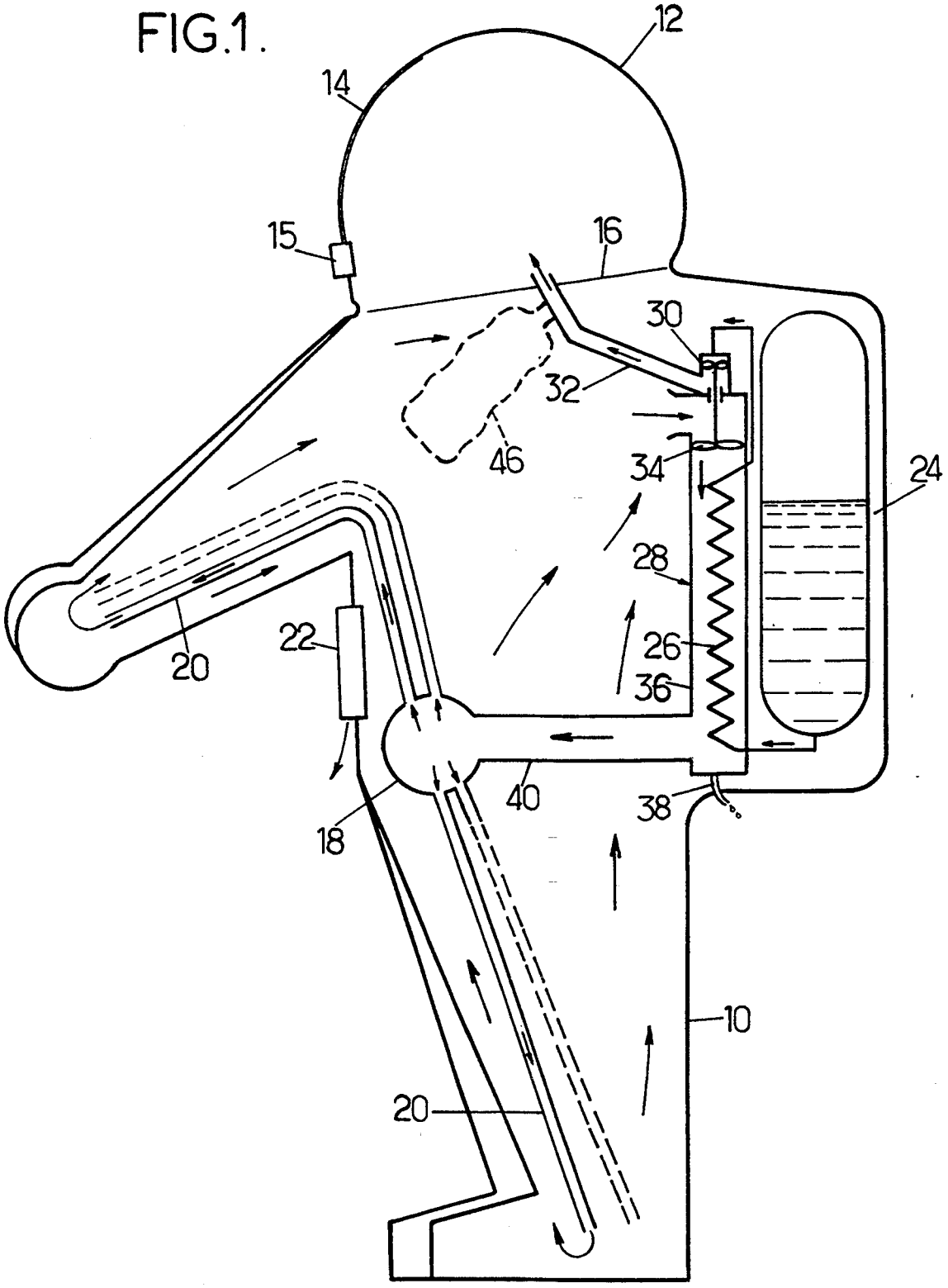
Fig. 1 schematically shows the general construction of an individual protection equipment according to a particular embodiment of the invention, which is particularly simple in design.

The breathing equipment schematically illustrated in FIG. 1 includes a closed suit having a garment 10 and a helmet provided with a transparent visor 14. The helmet is provided with an exhalation valve 15 adjusted to maintain an overpressure around the head, of some millibars as compared with the ambient atmosphere. A neck joint 16 applied against the skin separates the space around the head from the volume around the balance of the body. The neck joint 16 may be substituted with a face joint or with an oro-nasal mask. The garment is provided with a network of tubes for organizing a ventilation gas flow along the limbs and torso. In the embodiment given as an example, the pipe network comprises a distributor 18 feeding tubes 20 which bring gas to the extremities of the limbs, while return occurs as a flow along the limbs toward the space around the torso. One or more loaded valves 22 are located across the garment for maintaining an overpressure within the garment. The overpressure will frequently be of about 2 millibars when the suit is used in an environment under normal atmospheric pressure. That amount is sufficient for avoiding that the suit be invaded with dangerous or corrosive products from the outside.

In a bag attached to garment 10, or even within the garment, there is a supply of breathing gas consisting of a liquefied gas storage tank 24. The tank belongs to a converter whose general construction is similar to that of the converters which are presently used in military aircrafts for delivering breathing gas to the crew. It is provided with a conventional pressure reducing valve (not shown) for controlling the pressure, at 5 bars for instance, and it feeds the coil 26 which constitutes the primary circuit of a heat exchanger 28. In the embodiment shown in FIG. 1, the outlet of the evaporating coil 26 feeds a rotary gas motor 30 whose output is connected to a conduit 32 which opens into helmet 12. An economizer bag 46 (in broken lines on FIG. 1) may be connected to conduit 12. The breathing gas which reaches the helmet cannot mix with the gas within the garment. Motor 30 drives a blower 34 for taking off gas from garment 10 and circulating it within exchanger 28 where the drawn gas is cooled and dried. For that purpose the heat exchanger 28 may include an envelope 28 for guiding the gas, having a lower wall provided with means for discharging the condensate, which may consist of a tube 38 having a small cross-sectional area.

In that case, the upper portion of envelope 36 may have a broad opening above blower 34, for drawing gas from the garment 10. The lower portion of envelope 36 feeds manifold duct 40 which opens into distributor 18. The collected gas flows across blower 34, sweeps coil 26, enters distributor 18 end from there is sent to the extremities of the limbs.

Figure 2:
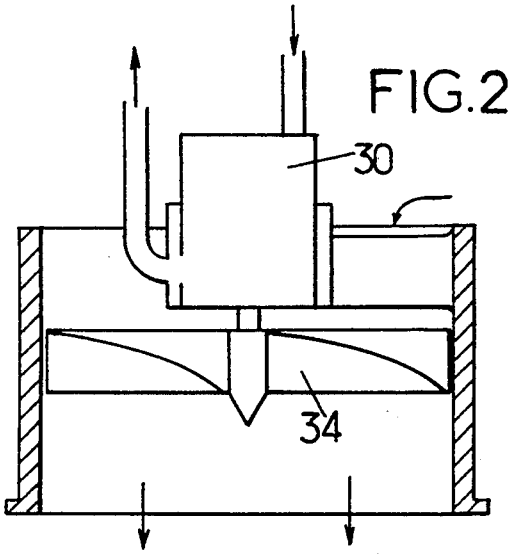
FIG. 2 shows a possible construction of the turbine-blower unit included in the equipment of FIG. 1.

Motor 30 and blower 34 may have various constructions. As shown in FIG. 2, the motor 30 consists of a turbine whose output shaft carries a blower propeller 34. The diameter of the turbine may be much lower than that of the blower propeller, since the flow rate across the turbine is much smaller than that which must circulate along the secondary circuit of the exchanger. For instance if the flow rate across the turbine is of from 8 to 15 l/mn, the flow rate in the blower will typically be comprised between 150 and 200 l/mn. On the other hand, the intake pressure of the motor may be of some bars while some millibars are sufficient for overcoming the head losses in the ventilation circuit. Air delivery to the blower may consequently be through an annular space formed around the turbine. The delivery of breathing gas to the turbine and output of gas may be through lines having a small diameter.

Figure 3:
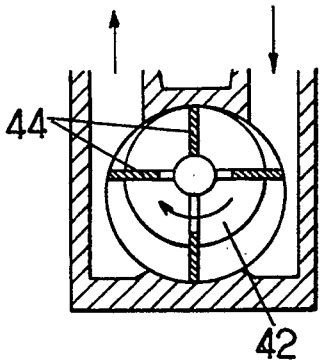
FIG. 3 is a schematic cross-section of e blade gas motor which may constitute the motor of FIG. 1.

Motor 30 may have other constructions. For instance it may consist of e displacement machine, such as for instance the pneumatic paddle motor illustrated in FIG. 3, rather then an expansion turbine. The rotor 42 which carries the paddles 44 is again drivebly connected to blower 34.

Figure 4:
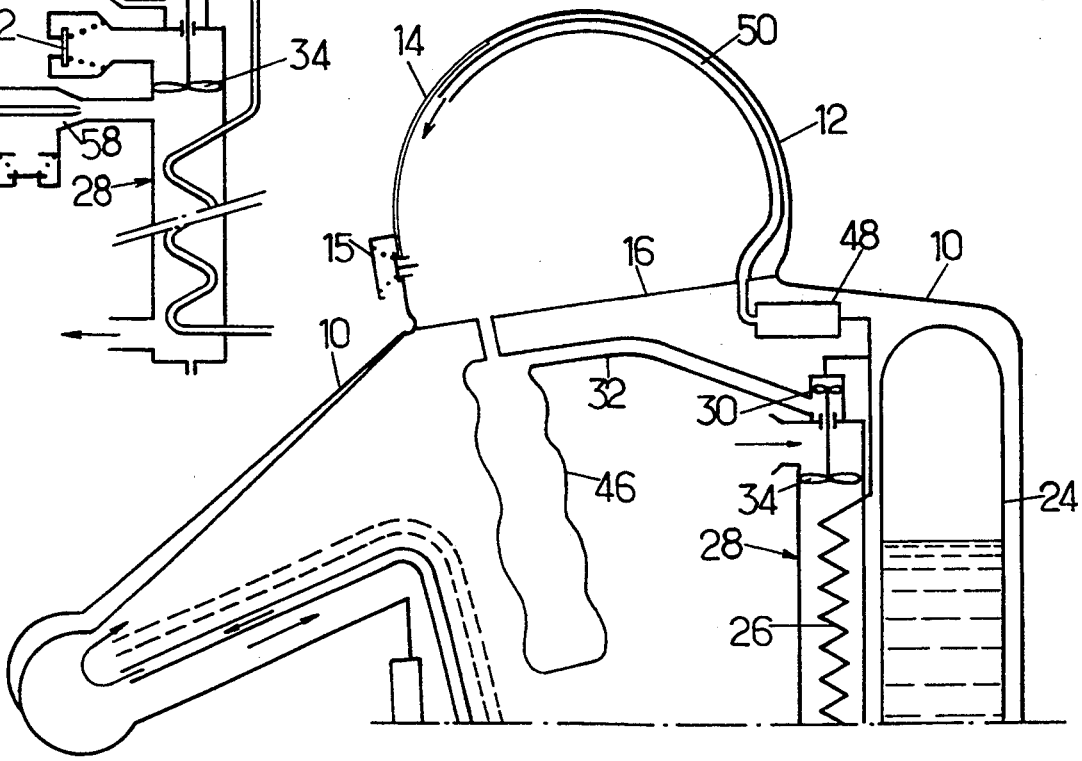
FIG. 4, similar to part of FIG. 1, illustrates a modified embodiment.

In the modified embodiment illustrated in FIG. 4 (where the components already shown in FIG. 1 are designated with the same reference numeral) only part of the breathing gas vaporized In the coil 26 or exchanger 28 passes through turbine 30. That arrangement makes it possible to direct a flow rate which have small variations to turbine 30. The exceptional peaks of breathing flow due to a physical effort are through a demand regulator, which may be conventional, connected as a by-pass.

More precisely, the output of the coil of exchanger 28 is connected to two circuits which open into the helmet.

The first circuit is similar to that shown in FIG. 1, but it includes a flexible economizer bag 46, accommodated within the garment and having a inner volume which is typically of about one liter when it is inflated. Bag 46, which is connected upstream of the opening into helmet 12 and downstream of motor 30, is for adapting the continuous flow from the gas motor 30 to the alternating breathing flow, without any increase in the consumption.

The second circuit includes a demand regulator 48, having a reference pressure pick-up within the helmet, for controlling the flow rate. It feeds a diffuser 50 for removing moisture from visor 14, opening into the helmet.

Due to that arrangement, exhalation is directly toward the atmosphere, out of the closed suit, which avoids retaining exhalated moisture and carbon dioxide.

Intermediate approaches, which use only part of the arrangements illustrated on FIG. 4, are also possible.

Figure 5:
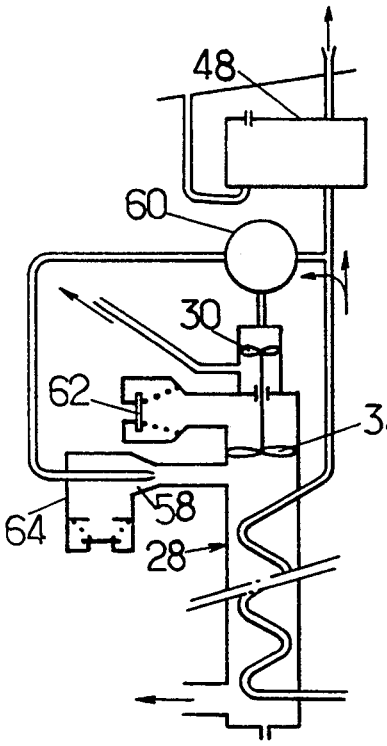
FIG. 5, similar to part of FIG. 1, illustrates still another modified embodiment, which authorizes emergency operation, in case of failure of the motor.

The modified embodiment illustrated in FIG. 5 differs from the preceding one due to the presence of means for feeding the secondary circuit of exchanger 28 either through blower 34 (normal operation) or through an ejector 58 for drawing air from the garment.

The selection means comprise a three way valve 60, which is manually controlled or which is automatically controlled responsive to failure of the motor-blower unit. In a first position, valve 60 directs part of the gas leaving the primary circuit of the exchanger toward the gas motor 30. In the second position, it directs that gas fraction toward ejector 58.

For avoiding that, in the second situation, the mixture drawn by the ejector leaks through blower 34, a non return check valve 62 is located on the air intake to the blower. Another check valve 64 avoids leaks when the blower operates.

The invention is not limited to the specific embodiments which have been shown and described as examples and it should be understood that the scope of the present patent extends to any equivalent system.

What is claimed is:

1. An individual protective equipment for use in a hostile environment, comprising a closed suit including a flexible gas-tight garment and a helmet having a transparent visor and having a gas-tight connection with said garment, sealing means in said helmet for separating a respiratory volume in communication with the mouth and nose of a wearer of said suit from the remainder of an inner volume of said suit, an exhalation valve in said helmet maintaining a predetermined overpressure in said respiratory volume, a storage tank for storage of liquefied breathing gas, a heat exchanger including a primary circuit having an inlet connected to an outlet of said storage tank and having an outlet, and a gas motor-blower unit having a gas motor connected to receive from said primary circuit outlet a flow of said breathing gas evaporated in said primary circuit and to deliver said flow to said respiratory volume and having a blower drivably connected to said motor and inserted in a closed loop garment ventilation circuit including a secondary circuit of said heat exchanger, said garment ventilation circuit being separate from a breathing circuit including said storage tank, said primary circuit and said respiratory volume; said individual protective equipment further includes means for separating said secondary circuit from said blower unit and drawing gas from said remainder of the inner volume of the suit.

2. Equipment according to claim 1, Wherein said means includes one of at least of a neck joint, a face joint and an oro-nasal mask.

3. Equipment according to claim 1, further comprising an economizer beg located within said garment and connected to said breathing circuit.

4. An individual protective equipment for use in a hostile environment, comprising a closed suit including a flexible gas-tight garment and a helmet having a transparent visor and having a gas-tight connection with said garment, sealing means in said helmet for separating a respiratory volume in communication with the mouth and nose of a wearer of said suit from the remainder of an inner volume of said suit, a storage tank for storage of a liquefied breathing gas, a heat exchanger including a primary circuit having an inlet connected to an outlet of said storage tank and having an outlet, a gas motor-blower unit having a gas motor connected to receive part only of the evaporated breathing gas flow passing out of said primary circuit while the remainder of the breathing gas flow from said primary circuit is directed to said respiratory volume via a demand regulator, and having a blower drivably connected to said motor and inserted in a closed ventilation circuit for said garment including a secondary circuit of said heat exchanger, said ventilation circuit being separate from a breathing circuit including said storage tank, said primary circuit said demand regulator and said respiratory volume; said individual protective equipment further includes means for separating said secondary circuit from said blower unit and drawing gas from said remainder of the inner volume of the suit.

5. Equipment according to claim 4 further comprising an economizer bag located within said garment and connected to the output of said gas motor.

6. An individual protective equipment for use in a hostile environment, comprising a closed suit including a flexible gas-tight garment, a helmet having a transparent visor, having a gas-tight connection with said garment, means for separating a respiratory volume in communication with the nose and mouth of a wearer of said suit from the remainder of an inner volume of said suit and an exhalation valve for direct discharge from said respiratory volume to atmosphere;

a storage tank for storage of liquefied breathing gas;

a heat exchanger having a primary circuit comprising an inlet connected to an outlet of said storage tank to receive said liquefied breathing gas and an outlet delivering evaporated breathing gas; and a unit comprising a rotary gas motor and a rotary blower drivably connected to said gas motor, wherein said gas motor is connected to receive part of said evaporated breathing gas from said outlet and to deliver said part, after it has passed through said gas motor, to said respiratory volume, wherein the remainder of said evaporated breathing gas is directed to said respiratory volume via a demand regulator by-passing said gas motor, and wherein said rotary blower is inserted in a closed garment ventilation circuit including a secondary circuit of said heat exchanger.

7. An individual protective equipment for use in a hostile environment, comprising a closed suit including a flexible gas-tight garment and a helmet having a transparent visor and having a gas-tight connection with said garment, sealing means in said helmet for separating a respiratory volume in communication with the mouth and nose of a wearer of said suit from the remainder of an inner volume of said suit, an exhalation valve in said helmet maintaining a predetermined overpressure in said respiratory volume, a storage tank for storage of liquefied breathing gas, a heat exchanger including a primary circuit having an inlet connected to an outlet of said storage tank and an outlet of said storage tank and having an outlet, and a gas motor-blower unit having gas motor connected to receive, from said primary circuit outlet, a flow of said breathing gas evaporated in said primary circuit and to deliver said flow to said respiratory volume and having a blower drivably connected to said motor and inserted in a garment ventilation circuit including a secondary circuit of said heat exchanger, and selection valve means for optionally separating said secondary circuit from said blower and simultaneously opening a communication between an outlet of an ejector fed with gas evaporated in said secondary circuit and a means for drawing off air from the inside of said garment.

* * * * *